US005749258A

United States Patent [19]

Werth

[11] Patent Number: 5,749,258

[45] Date of Patent: *May 12, 1998

[54] TOOLING AND METHOD FOR FORMING A CONTAINER

[76] Inventor: Elmer D. Werth, 7025 W. 61st Ave., Arvada, Colo. 80003

[ * ] Notice: The term of this patent shall not extend beyond the expiration date of Pat. No. 5,630,337.

[21] Appl. No.: 801,039

[22] Filed: Feb. 14, 1997

Related U.S. Application Data

[63] Continuation-in-part of Ser. No. 524,480, Sep. 7, 1995, Pat. No. 5,630,337.

[51] Int. Cl.[6] ..... B21D 22/20

[52] U.S. Cl. ..... 72/467; 72/347; 72/379.4

[58] Field of Search ..... 72/347, 348, 349, 72/379.4, 467

[56] References Cited

U.S. PATENT DOCUMENTS

| | | | |
|---|---|---|---|
| 4,106,422 | 8/1978 | Buhrke | 113/121 C |
| 4,244,315 | 1/1981 | Klein | 113/121 C |
| 4,603,571 | 8/1986 | Wessels | 72/349 |
| 5,630,337 | 5/1997 | Werth | 72/467 |

FOREIGN PATENT DOCUMENTS

| | | |
|---|---|---|
| 68377 | 1/1941 | Czechoslovakia . |

OTHER PUBLICATIONS

K. Forth, New Company Has Been Around for Can Manufacturers, CanTech International, Oct./ Nov. 1994.

*Primary Examiner*—Lowell A. Larson
*Attorney, Agent, or Firm*—Kyle W. Rost

[57] ABSTRACT

A die (104) for forming a blank (14) into a container body (26) having an open end provides an annular undulated shaping surface (106) of substantially uniform radius. The container body (26) is formed by moving the blank through the shaping die (104), with the result that the undulations (106) laterally redistribute metal in the sidewall of the container body, as well as iron the sidewall during the forming process. The die enables the use of a blank (14) of noncircular geometric shape, such as a hexagon, by redistributing metal from the points of the hexagon to the area of the flats in order to produce an end product without excessive earing.

25 Claims, 5 Drawing Sheets

TOOLING AND METHOD FOR FORMING A CONTAINER

CROSS-REFERENCE TO RELATED APPLICATION

This application is a continuation-in-part of U.S. patent application Ser. No. 08/524,480, filed Sep. 7, 1995, now U.S. Pat. No. 5,630,337 issued May 20, 1997.

TECHNICAL FIELD

The invention generally relates to sheet metal container making, especially to methods of forming or treating a metallic closure and container body. Aspects of the invention relate to the draw and iron method of forming container bodies, including blanking closures or container bodies from sheet stock, cupping, body making, trimming, flanging, closing, and seaming of metal containers. Disclosed is a method of forming containers from sheet stock while utilizing substantially all of the material from the sheet stock and thereby minimizing scrap. The method also is applicable to flowable materials other than metal.

BACKGROUND ART

The manufacture of two piece containers such as metallic beverage cans by the draw and iron process is widely practiced. According to this known technique, sheet metal coil stock is fed into a machine called a cupper. There, the sheet is blanked into round discs of metal. These discs are cut in a close pattern, with the rows nested with each other to the extent possible. However, a web of metal remains behind after the discs are removed, and this web constitutes scrap. The cupper then processes the discs so formed into shallow cups, which are substantially wider in diameter than the finished can body. The scrap may be disposed of an various ways, including reprocessing it into additional sheet stock.

The blank, now formed into a cup, is further processed in a bodymaker machine. Here, a punch pushes each cup through a series of dies. The first die is a redraw die that reduces the diameter of the cup to the eventual diameter of the finished can body. Subsequent dies draw and iron the side walls of the can body, extending them to increased height, generally greater than the finished height of the can. The open end of the can body is quite irregular after bodymaking and, thus, the can body is further processed in a trimming machine. There, the irregular open end is trimmed off, leaving behind a can body of standard dimensions and finished open end edge. The trimmer leaves another scrap, which can be reprocessed to form additional stock.

After trimming, often the can body is further processed by printing a decoration on the outer surface wall and necking-in the open end. With or without necking-in, the can body then is flanged at the open end. At this point, the body may be filled with its intended contents. Once filled, the body is closed by applying a lid over the flanged end and seaming the lid and flanged end.

A few examples in the prior art suggest that flat stock can be formed into a cup or can body by special, nonuniform shaping. A recent article, K. Forth, *New Company Has Been Around For Can Manufacturers,* CanTech International, October/November 1994, describes a process for cutting blanks having the shape of a modified hexagon. The modified hexagon shape is processed by conventional machinery into a can body, taking advantage of the grain of the sheet stock to convert the modified hexagon into a round can having reduced earing. The process reduces the amount of scrap by allowing a closer blanking pattern. Other than using a novel shape in the blanking press, forming cans from this modified hex blank employs standard draw and iron technology.

U.S. Pat. No. 4,603,571 to Wessels also discloses forming a hexagonal blank into a round cup by, first, drawing the blank into a hexagonal cup and, second, drawing the hexagonal cup into a round cup. This patent suggests that in the first draw, the die and the blank are aligned such that the points of the blank lie along the flat sides of the noncircular die. Thereafter, circular draw and iron dies are used.

Czech Patent No. 68377 discloses a machine for deep drawing sheet metal. This machine holds flat stock between the plates consisting of a lower female die plate and an upper press plate, while a punch or male die is pushed downwardly through the female die at the center of the stock. The plates carry circular grooves filed with lubricant so that the sheet metal slips through the press to avoid tearing as the center is deep drawn by the punch and die set. This patent provides an example of drawing a conventional circular cup by using lubrication grooves on the faces on the press plates.

Several patents disclose techniques of saving metal in forming lids, also known as can ends. Of note is U.S. Pat. No. 4,244,315 to Klein, which proposes that lids might be blanked from square blanks, from scrolled strips of metal, or from wide sheet stock, in each case employing a preliminary closure forming step that draws metal from outside the border of the lid. The pattern in which the lids are arranged is a staggered, hexagonal, honeycomb arrangement, intended to produce a maximum number of lids from a given amount of sheet metal. However, it is notable that the lids, when cut from the sheet stock, are circular, leaving behind a substantial scrap at the interstices of the pattern.

Other notable art is found in U.S. Pat. No. 4,106,422 to Buhrke, which proposes that lids be formed while remaining integral with the coil stock. Various processing is applied to the lids to finish them to the maximum extent possible before the lids are cut from the stock. Thus, prior to being finally cut, the lids are carried in the stock in a local area of metal having plane geometric outlines. However, when finally cut, the lids are circular and leave behind scrap.

As shown, it would be desirable to form container bodies by a more efficient usage of sheet stock. Further, it would be desirable to use the generally known techniques of the draw and iron process, but with far less scrap then is presently produced. While the prior art shows several attempts to improve efficiency in blanking the sheet stock and then forming shaped cups, the special shaping process has ended with the cupping operation. In particular, the annular surfaces of the cupping or ironing dies have not been specially shaped to improve the final shape of the can body formed from a noncircular blank, despite the fact that a large percentage of the forming process takes place in the ironing dies.

Similarly, it would be desirable to form lids with reduced scrap.

To achieve the foregoing and other objects and in accordance with the purpose of the present invention, as embodied and broadly described herein, the product and method of manufacture of this invention may comprise the following.

DISCLOSURE OF INVENTION

Against the described background, it is therefore a general object of the invention to provide an improved method and apparatus for forming container bodies, wherein an increased portion of sheet stock is utilized in forming the blanks for the can ends and can bodies.

A more specific, alternative object is to define blanking areas of regular geometric, non-circular perimeter, wherein the contained volume of metal is closely similar to the volume conventionally employed in a round blank for forming a similar object.

A further alternative object is to provide a method of forming container bodies wherein each blank is in the form of a hexagon, such that the coil stock is substantially entirely consumed by division into juxtaposed hexagons. In the alternative, an object is to provide a method of forming container bodies wherein each blank is in the form of a hexagon, such that the coil stock is consumed more completely than is possible in present practice.

A further object is to perform cupping, redrawing, and ironing in such a way as to suitably distribute the metal from a hexagonal blank into a finished can body.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, a tool for forming a blank into a container body having an open end provides a die having an annular shaping surface about a central axis. The shaping surface is of substantially uniform radius with respect to the central axis. At a plurality of preselected, spaced locations about the annular shaping surface, an edge of the shaping surface is disposed at an acute angle with respect to the central axis of the die.

According to another aspect of the invention, the shaping surface is a continuous face having a leading edge along one of its axially facing sides. The leading edge is the edge that is disposed at an acute angle with respect to the central axis.

According to still another aspect of the invention, a method of forming a container body employs the steps of providing a blank of sheet material and a punch moveable with the blank through a shaping die along a longitudinal axis. The shaping die is provided with an annular working surface positioned concentrically about the longitudinal axis of punch movement, and the annular working surface of the shaping die carries a face disposed in an undulated pattern and at a constant radius from the axis. The container body is formed by moving the punch with the blank through the shaping die, with the result that the undulations laterally redistribute metal in the blank, as well as iron the walls during the forming process.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

The present invention provides an efficient utilization of metal or other stock material, including plastics and other synthetics, for the manufacture of containers. The disclosed method chiefly is applicable to the production of two-piece containers, such as aluminum or steel beverage cans formed from a body and lid. This technology is described as adapted for use with the conventional steps of draw and iron container manufacturing. While such draw and iron technique is in common use, the invention anticipates that still other techniques might be used and that the invention might be applied to the production of lids as well as container bodies.

Figure 1:
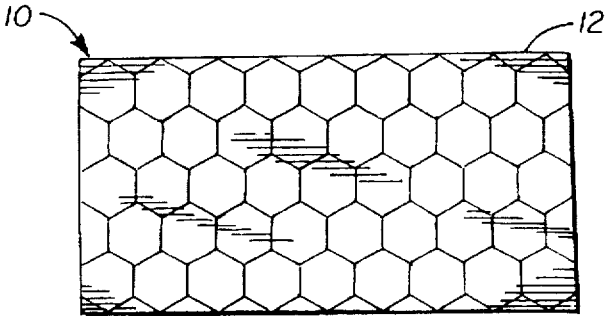
FIG. 1 is a top plan view of a section of sheet stock, showing the preferred, nested pattern of hexagonal blanks for the formation of either container bodies or ends.

With reference to FIG. 1 of the drawings, the method of forming a metal container body or lid is applied to the sheet stock 10 from which the container component is to be manufactured. The sheet stock is provided in a size suited for division into a plurality of container body or end blanks. For example, five or more rows of hexagonal blanks are required to cross the width of the sheet stock 10. While such sheet stock conventionally is divided into a plurality of blanks having circular configuration, the invention provides that the sheet stock be divided, instead, into a plurality of blanks each having a non-circular geometric shape. Blanks of the selected shape may be capable of abutting each other to substantially eliminate scrap in the blanking process. Further, the invention contemplates that a means might be provided to remove scrap from the blanking machine, and for this purpose the blanks might be separated by a skeleton of residual sheet stock. If used, such skeleton may have minimal dimensions, providing merely such integrity as is required to ensure its removal from the blanking machine. Other removal means might include a mechanical wiper, air or vacuum. In the drawing, the blanks are shaped as regular polygons, with the regular hexagon being the single preferred geometric shape. The hexagon provides high density of blanks with a substantial absence or minimalization of scrap.

The division of the sheet stock into a plurality of blanks is accomplished by any suitable separating process or means, including cutting, stamping, or other parting operations. The term, "blanking," is applied to this formation of individual sections of metal sheet stock, wherein each section is further processed into the desired component, such as a container body or lid. As applied to this invention, "blanking" means the formation of sections of sheet stock for further processing that will form at least side walls prior to any substantial trimming of metal from the blank. Significantly, the blank is sized to contain substantially the minimum quantity of metal required to form the component, except as the manufacturing process later may cause the need for trimming. This minimum quantity of metal may be equivalent to the quantity of metal found in a conventional circular blank. Thus, this usage of the term, "blanking," is to be distinguished from other usages wherein the segments contain substantial excesses of metal that are trimmed or become scrap before such trimmings are first subjected to substantial forming or processing.

The preferred technique for blanking is to feed the sheet stock into a cupping machine of generally known design, in which the stock is blanked and cupped. Such cupping machine is adapted to define and separate the blanks in nested configuration, such as that shown in FIG. 1, in which each row of blanks is staggered by one-half the dimension of a blank from the neighboring rows. Thus, the interstices between blanks in each row are incorporated into the blanks of the neighboring row to the greatest extent possible, with allowance for a residual skeleton of sheet stock, if such is desired. In the case of hexagonal blanks, geometry permits the elimination of unused interstices except marginal scrap 12 at the margins of the sheet stock. This utilization of the sheet stock can be said to permit generation of substantially no scrap, since when hexagons are employed, parting from immediately juxtaposed blanks may be entirely along common borders. Each blank may share the maximum number of straight sides with immediately juxtaposed neighbors, such that when shapes other than hexagons are used, scrap is minimized.

Figure 2:
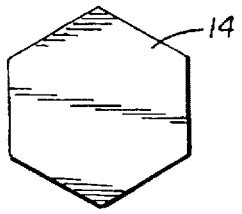
FIG. 2 is an enlarged top plan view of a single hexagonal blank.

FIG. 2 shows a typical regular hexagonal blank, in which each of the six sides is equal in length, and the sides are joined at equal angles. At the junction of each neighboring pair of sides, a point is defined. During the container forming process, the material of construction near the point of the blank is to be spread laterally, so as to be a useful part of the finished container body or lid. The method and equipment for achieving this spreading will be generally and specifically described below.

Figure 3:
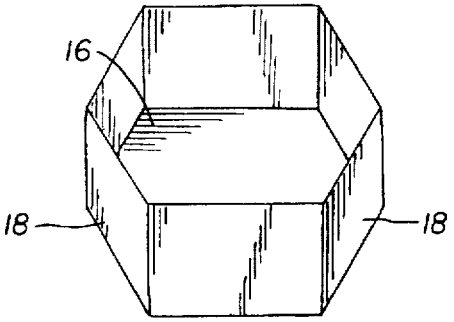
FIG. 3 is an isometric view of a hexagonal-shaped cup formed from the blank of FIG. 2.

The blanks 14, once formed as shown in FIG. 2, then are cupped. In the well known draw and iron process, the cupping machine forms the blank into a shallow cup. Such forming may be accomplished by punching the blank to deform it. The polygonal blank 14 may be processed by punching with a similarly configured punch and die set. Thus, for example, the hexagonal blank 14 can be formed into a hexagonal cup 16 as shown in FIG. 3 by punching it with a hexagonal punch and die set. The side walls 18 of this cup are disposed in the general shape of a hexagon.

Figure 6:
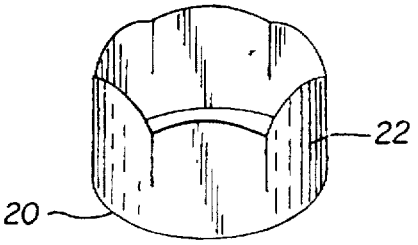
FIG. 6 is an isometric view of a cylindrical cup formed from the blank of FIG. 2 or the hexagonal cup of FIG. 3.

However, if desired, the hexagonal blank 14 can be cupped by applying a cylindrical punch and die set, with the result being the cylindrical cup 20 shown in FIG. 6. The side walls 22 of cup 20 are disposed in a generally circular shape, such that the cup is generally cylindrical. The punch may accommodate the polygonal shape of the blank by allowing extra space between the punch and its forming die, so as to not overly extend the metal near the intersections of the polygon's sides. Alternatively, a specially configured die may be used, as described below. The resulting cup 20 appears to be similar to the cylindrical cups of the prior art, except that the side walls may be relatively thicker at points corresponding to the intersections of the polygon's sides. Alternatively, the cup 20 may have ears where extra metal remains in the side wall.

In order to extend the side walls of the cupped blank 20, a drawing and ironing process is employed. Conventionally, a contoured punch pushes the cup through a redraw die, followed by a series of ironing dies. The redraw die reduces the diameter of the cup, while each ironing die extends the side wall of the cup, and a sufficient number of dies are employed to achieve a predetermined length of extension. Typically, the ironing dies interact with the punch to distribute the metal from the cup over the punch in a desired distribution. The resulting product is a container body having an open end with slightly irregular lip. No point of the lip should be shorter than a predetermined height, so that the lip can be trimmed to form an even edge at such predetermined height.

Figure 4:
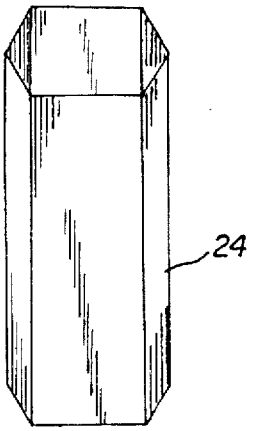
FIG. 4 is an isometric view of a drawn and ironed hexagonal-shaped container body formed from the hexagonal cup of FIG. 3.
Figure 7:
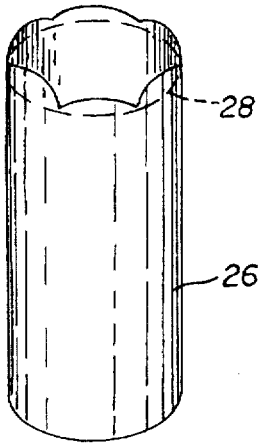
FIG. 7 is an isometric view of a drawn and ironed container body formed from the cup of FIG. 6.

The polygonal cup 16 may be drawn and ironed by either of two methods. First, this cup can be processed on a similarly shaped polygonal punch passing through polygonal dies. The resulting container body 24, FIG. 4, has generally polygonal side walls. However, in the alternative, cup 16 may be processed through a generally circular punch and die set so as to form a cylindrical cup or container body 26, FIG. 7. Cylindrical cup 20 also may be drawn and ironed through a generally circular punch and die set to produce a container body 26. The punch and die set should be configured to distribute the metal in the cup walls as evenly as possible in the formed body.

Figure 5:
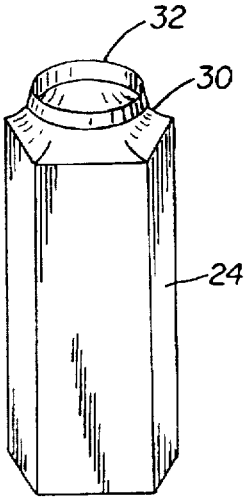
FIG. 5 is an isometric view of a necked-in, hexagonal-shaped container body formed from the body of FIG. 4.

The container body 24 or 26 may be further processed according to generally known techniques. The uneven lip surrounding the open end of the body can be trimmed off at an even height, as shown by the dashed line 28, FIG. 7. If it is desired to neck-in the container side wall at the open end, various equipment is known to employ stationary dies, rotating dies, and orbiting rollers, all capable of forming a substantially circular neck 30, FIG. 5. The trimmed end of a container body then can be die formed or roll formed to define a flange 32, in preparation for filling the container, applying the lid, and seaming the lid to the container.

Figure 8:
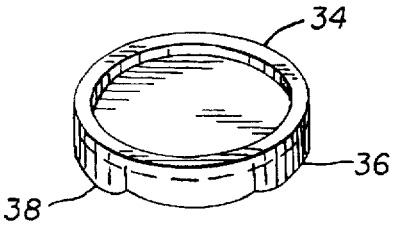
FIG. 8 is an isometric view of a container end formed from the blank of FIG. 2.

A container lid or end 34 is shown in FIG. 8, formed from a hexagonal blank 14. The lid 34 is formed by forcing the blank through a punch and die set similar to those used to form cup 20. The depending ears 36 can be trimmed at the dashed line 38.

Figure 9:
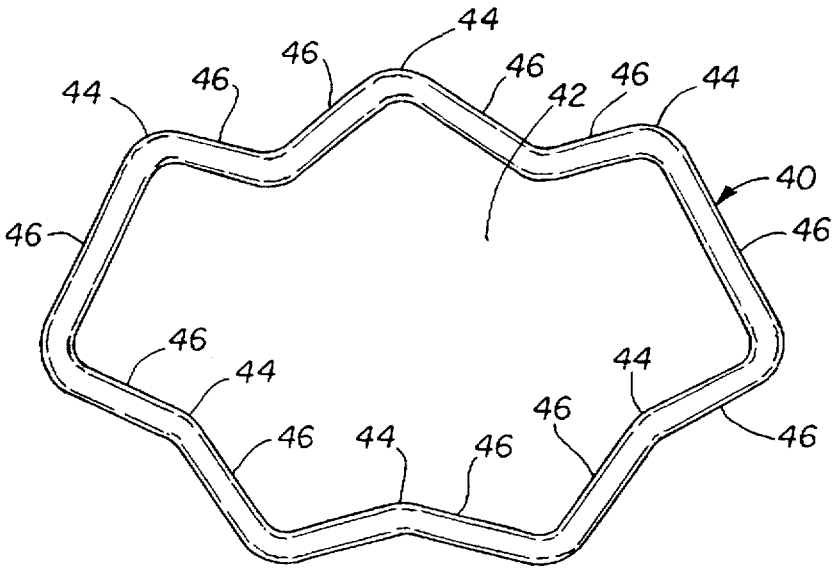
FIG. 9 is an isometric view of a die for converting a hexagonal member into a cylindrical member.

With reference to FIG. 9, a die element 40 works in combination with a punch to transform a hexagonal blank into a cylindrical container body. The die element is configured to move material both longitudinally and laterally in such a way as to minimize ears and wastage that otherwise would result from cupping an irregular shape. This die element or its equivalent can be applied after blanking, in the cupping process. Similarly, it may be applied after cupping, in the redrawing process. Still further, it may be applied after the redrawing process, in the ironing process. The die element 40 or its equivalent can be applied in one, some, or all of these steps, as required to produce a container body whose open end is not excessively irregular. Since any draw and iron process produces a certain amount of earing, it is expected that the open end of the can bodies subsequently will be trimmed. Die element 40 is employed to reduce earing that otherwise would result from the presence of extra material at the points of the hexagonal blank.

The die element 40 is used in an ironing ring or similar cupping die or redraw die. It is oriented to lie in an approximately transverse plane to the longitudinal direction of container body movement. The die element has a substantially circular central passageway 42 that accommodates a substantially cylindrical punch, while allowing a clearance between the die element and punch that allows passage of the container body, as it known in the art. In one embodiment, if the circular center passageway is viewed as lying in a single plane, the walls of the die form undulation features such as a leading edge configured in a zig-zag pattern, oriented to lie on the annular surface of a perpendicular cylinder to the plane of the circular center passageway. The side walls of the die provide a means for locally laterally spreading the sheet material of the can body workpiece, as the workpiece is drawn through the die. The local spreading of the container material takes place at localized areas of the blank, such as in general longitudinal alignment with the points of the hexagonal blank, or those areas of the processed workpiece corresponding to the former position of those points. Those areas of the blank or processed workpiece will be referred to as the point areas, while the areas between the point areas will be referred to as the intermediate areas. The blank or workpiece is processed through the die element 40 with the undulation features, such as leading edge portions of the zig-zag wall aligned with localized areas of the blank, such as the point areas.

In one embodiment, the zig-zag leading edge of the side wall of die element 40 is formed as six longitudinally protruding, generally wedged-shaped apex sections 44, extending in the longitudinal direction of the leading face of the die, which is the die face that is directly opposed to the direction of punch and workpiece movement. Each apex section tapers back along trailing edges 46. A blank 14 or processed workpiece is pushed through the die by a longitudinally moving punch, and the workpiece is reshaped by the die. While conventional portions of the processing may, for example, extend the workpiece side wall by ironing action, the workpiece material also is shaped and deformed by the apex sections 44, which spread the workpiece material laterally toward the two trailing edges of each wedge, which correspond to the intermediate areas of the workpiece. As previously noted, the blank 14 or processed workpiece is passed through the die with the point areas aligned with the apex sections 44. In this way, the excess of material in the general area of the point areas is laterally or circumferentially distributed, in a plowing type of action.

While the concept of lateral or circumferential displacement is established by a single apex section corresponding to each point area of the workpiece, still other die element configurations could accomplish the same function. For example, an apex section could be formed with plural longitudinally separated apexes, waves, edges or ribs to gradually circumferentially spread the workpiece material as the workpiece successively encounters each one, while the trailing edges 46 might have only a single edge for performing conventional drawing and ironing functions. Further, the apex could be formed with a sharp leading point, multiple circumferentially juxtaposed leading points, or a soft leading curve substantially without a leading point. All of these structures could be employed as required to locally laterally spread the workpiece material from the point areas to intermediate areas as the drawing and ironing process takes place.

Another means for laterally distributing the material from the point areas is to employ a die 40 element having a slightly irregular radius at the central circular opening, formed to have each die wall area 44 slightly radially closer to the punch than are the trailing edges 46. The excess material at the points areas of the blank are displaced laterally, into the intermediate areas having more clearance with the punch. Thus, the means for circumferentially or laterally spreading the workpiece material from the point areas includes any combination of longitudinal or radial variations in the drawing and ironing die working surfaces.

Figure 10:
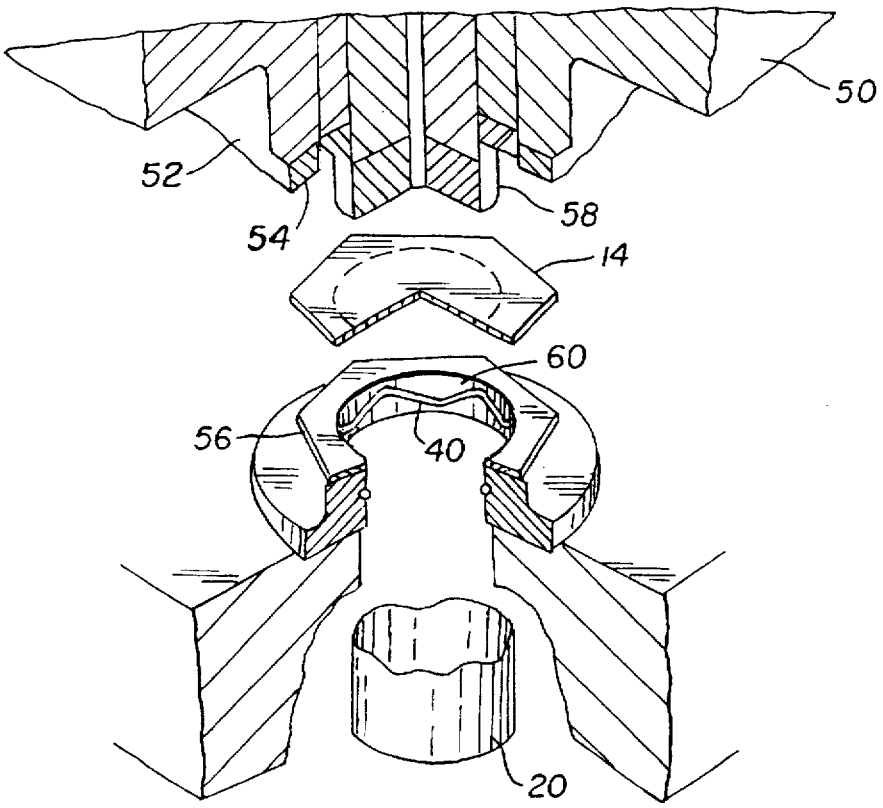
FIG. 10 is an isometric view of one station of a cupper for cutting hexagonal blanks and producing cups therefrom.
Figure 11:
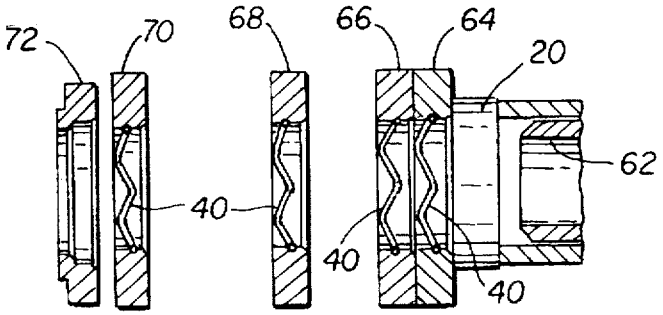
FIG. 11 is a schematic, side elevational view of one station of a bodymaker having dies for processing a cup produced from a hexagonal blank, showing the cup prior to moving through a redraw die.

Because the blank and die must be kept in registration in order to spread material at the correct locations, the blanking and cupping process offers an excellent opportunity to begin redistributing the workpiece material. A cupper 50, FIG. 10, is provided with a two part blank cutting die 52. The upper half die 54 and lower half die 56 cooperate to cut blank 14 from sheet stock (not shown) passing between the halves of die 52. In FIG. 10, the die 52 is shown to have a hexagonal configuration for cutting a hexagonal blank 14. As the cutting or blanking is performed, the blank remains engaged and registered in the blanking die. While the blank is so registered, a central punch die tool 58 pushes the blank through a cooperating draw die tool 60, forming the blank into the cup 20. The draw die tool 60 is configured to have a die element 40 on its working surface, positioned to spread the workpiece material laterally from the point areas. The resulting cup 20 may appear very similar to the conventional cup formed from a circular blank. If not, a die element 40 can be applied to the workpiece again in later processing.

FIGS. 11–14 show the sequence of the draw-and-iron process, which is performed in a bodymaker machine. The cup workpiece 20 is removed from the cupping machine and transferred to the bodymaker, where a punch 62 moves the cup workpiece through a further series of dies. Typically, these dies include the redraw die 64, the first ironing die 66, the second ironing die 68, and the third ironing die 70. At the end of this travel, the punch 62 moves the workpiece through a can body stripper 72.

Figure 12:
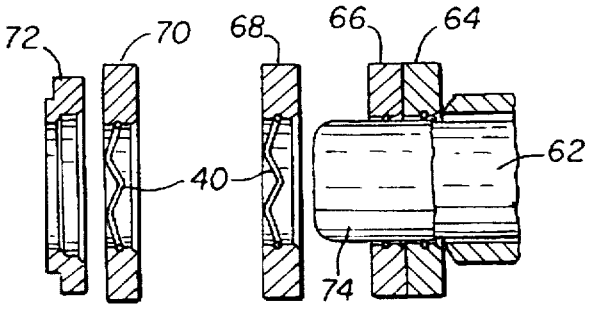
FIG. 12 is a view similar to FIG. 11, showing the can body moving through a redraw die and a first ironing die.
Figure 13:
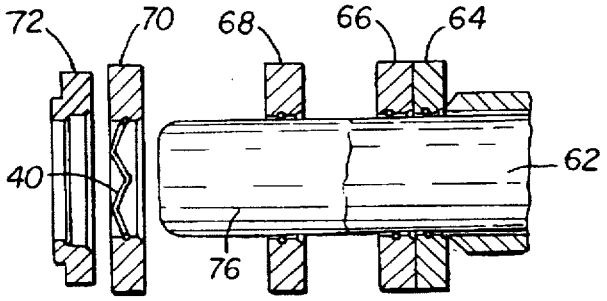
FIG. 13 is a view similar to FIG. 11, showing the can body moving through a second ironing die.
Figure 14:
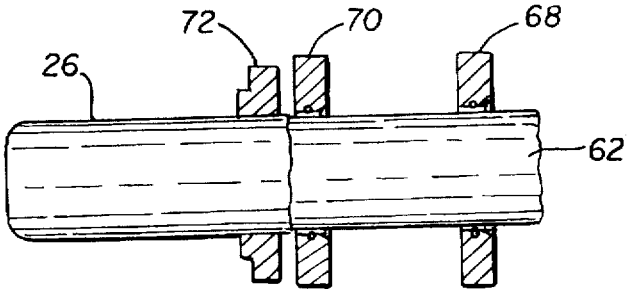
FIG. 14 is a view similar to FIG. 11, showing the can body after movement through a third ironing die.
Figure 15:
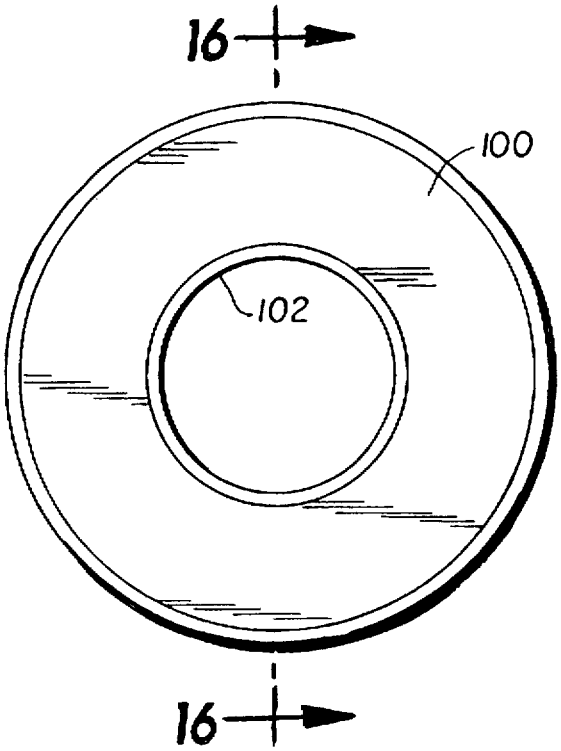
FIG. 15 is a front elevational view of a carrier ring and ironing die employing a modified shaping surface.
Figure 16:
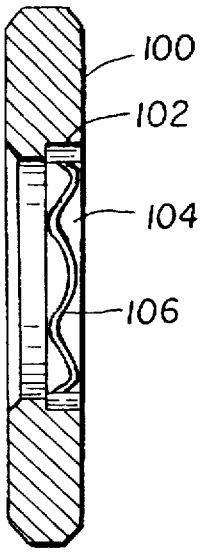
FIG. 16 is a cross-sectional view of FIG. 15, taken along the plane of line 16—16.
Figure 17:
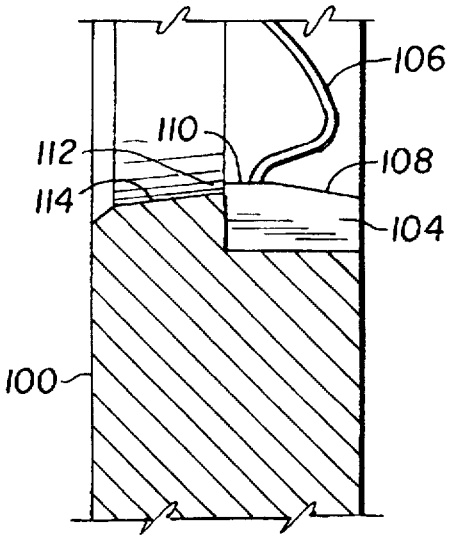
FIG. 17 is an enlarged detail view of the cross-section of FIG. 16, showing a cross-section taken at the bottom of FIG. 16.
Figure 18:
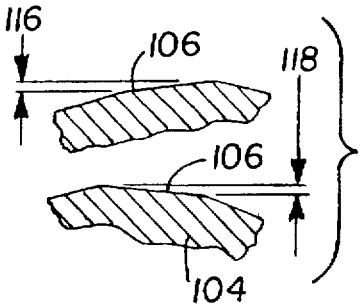
FIG. 18 is a further enlarged detail view showing the working surface of the ironing die of FIG. 17, illustrating allowable deviations of the working surface from perfect cylindricity.

Each of the dies 64–70 may be configured, as required, with die element 40 at its working face. The workpiece is subjected to lateral spreading of metal or other material from the point areas, by aligning the point areas with the apexes 44 or other spreading structures of die element 40. During conventional can forming steps, the die element 40 performs the added function of circumferentially or laterally redistributing the material from the point areas. Conventionally, the redraw die 64 reduces the diameter of the cup to the desired diameter of the container body and also lengthens the side wall. The ironing dies sequentially reduce the thickness of the side wall and further lengthen it. FIGS. 12 and 13 show the workpieces 74 and 76, respectively, at intermediate points in processing. At the completion of the draw-and-iron process as shown in FIG. 14, the container body 26 has been completed, with the extra metal from the points of the original blank laterally redistributed by die element 40.

EXAMPLE 1

Tooling Design

The tooling shown in FIGS. 15–18 was fabricated in order to establish that suitable annular shaping surfaces could be produced on the inside surface of a die ling. A die carrier ring 100 was produced of 4140 steel with an outside diameter of six inches, which is the corresponding tooling size specification for such carrier rings used in certain commercial bodymakers. The carrier ring bounds a central opening and adjacent to that opening defines an annular carrier recess 102 in the front face of the ring and about the center opening. Mounted in this recess 102 is an annular, carbide ironing die 104 having a three inch nominal outside diameter and mounted in the groove by a shrink fit.

Figure 19:
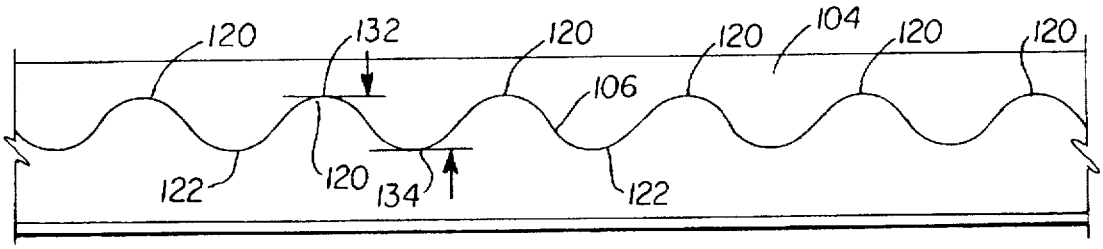
FIG. 19 is a developmental view of a shaping surface similar to that shown in FIGS. 16–18.
Figure 20:
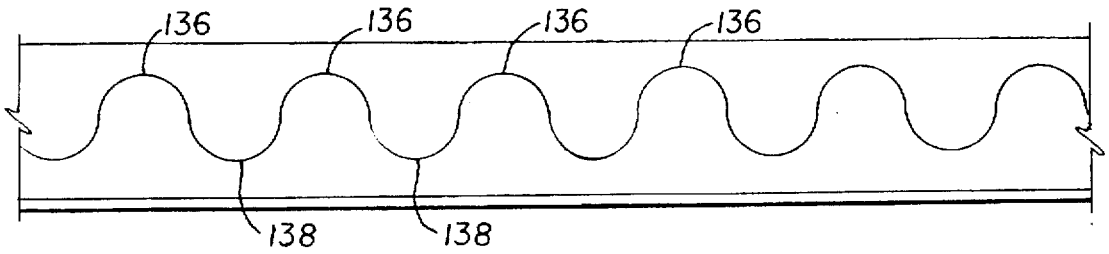
FIG. 20 is a developmental view similar to FIG. 19, showing a modified shaping surface.
Figure 21:
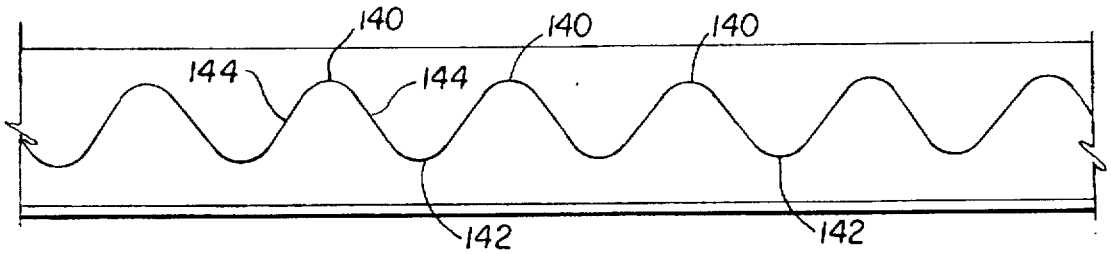
FIG. 21 is a developmental view similar to FIG. 20, showing a further modified shaping surface.

The working face 106 of the ironing die 104 is located on the inside annular surface of the die and is best shown in FIG. 19 to be undulated or serpentine in configuration and generally similar in form to a sine wave. For clarity, the view of FIGS. 19, 20, and 21 show the die patten with the inner face of the circular die displayed in a plane instead of a circle, which permits the pattern to be viewed without problems of perspective. The pattern, itself, is shown in simplified form as an undulated line, although the face 106, 136, 140 has a dimension, as shown in better detail for face 106 in FIGS. 16–18. The die is provided with an entry ramp 108 at its leading edge, having a forward flare of about eight degrees, relative to a centerline of the die. The die is provided with an exit ramp 110 having a rearward flare of about five degrees. The carrier ring opening is greater than the die opening, measured at the rear face of the die, creating an outward and rearward step at the rear face of the ironing die. From this outward step, the carrier ring also provides an exit ramp 114 having a rearward flare of, for example, five degrees.

The undulated working face 106 of the ironing die is defined between the entry ramp 108 and exit ramp 110. This undulated surface defines a continuous path around the interior face of the die, disposed at a substantially constant radius from the centerline or central axis of the annular die. The width of the face of the undulated surface may be about 0.025 inches, and the face is preferred to lie in a substantially perfect cylinder centered on the centerline or central axis of the die. However, face 106 may vary from perfect cylindricity by a small tilt or angular deviation, as measured between the diameters of the forward and rearward edges of the working face, shown as measurements 116 and 118, respectively, in FIG. 18. Typically, the maximum rearward tilt, shown in the upper detail of FIG. 18, may be no more than 0.0002 inches, while the forward tilt, shown in the lower detail of FIG. 18, may be no more than 0.00005 inches.

The face or working surface 106 performs the longitudinal ironing of the container wall as the container body moves longitudinally through the die, along the centerline or central axis of the die. The working surface also performs the lateral redistribution of blank material, moving material transversely to the central axis of the die. The serpentine pattern of the working surface is provided with six equal leading curves 120 in FIG. 19. These leading curves are preferred to be smooth rather than pointed or sharp. On its trailing edge, the working surface joins together each pair of juxtaposed leading edge curves by a smooth trailing edge curve 122. The leading edge curves and trailing edge curves may be symmetrical. Each undulation can be viewed as having an amplitude measured by the gap between the leading and trailing edges of the undulation, such as between lines 132 and 134 at the crests of opposite curves. This amplitude may be, for example, in the range from 0.150 to 0.216 inches. In a three die set as typically used in a bodymaker, the undulations of each die of different amplitude, as required to produce a product with the best distribution of wall material.

EXAMPLE 2

Container Forming

In order to evaluate the functionality of the tooling, the die of Example 1 was installed into a bodymaker in a can line. The die is positioned along the workpiece pathway such that die is perpendicular to the pathway, and the workpiece passes longitudinally through the annular die, centered on the centerline or central axis of the annulus. The bodymaker was operated in the usual way, moving preformed cups through the die to produce test can bodies. The stock fed into the bodymaker was cylindrical cups delivered from a cupper machine, which produced the cups from conventional round blanks. The purpose in feeding these cups was to evaluate the effectiveness of the undulated working surface 106 in both ironing the container walls and, at the same time, in selectively laterally redistributing metal from six equally spaced circumferential locations in the test cans.

The test cans were evaluated. Each had achieved a proper sidewall height, which established that the undulating die was effective to iron the wall material. Further, each test can showed six distinct ears arranged at equal spacing about the circumference of the open end, which established that the undulated die was effective to selectively laterally redistribute metal within the sidewall of the container body. The fact that six ears were produced at equidistant spacing showed that the undulations were effective to laterally redistribute metal.

The results of Examples 1 and 2 confirm the effectiveness of a geometric pattern in the form of an undulated annulus, applied to an annular shaping surface, to both longitudinally iron and laterally redistribute the metal of a container sidewall. This die is differentiated from all known prior art forming systems in that the working surface of the die can lie at a constant radius in near perfect cylindricity while achieving lateral redistribution of metal entirely by use of acutely angled shaping surface conforming to the cylindrical surface. The acute angle of the shaping surface is determined by considering the tangent plane to each point of the undulated shaping surface, as that tangent plane would intersect the centerline or central axis of the die. As noted above, the shape of the test die was an undulated pattern that resembles a sine wave. The tangent plane to the leading edge of such an undulated pattern may be viewed as perpendicular to the central axis, such as at the apex of an undulation, or acutely angled at less than 90° deviation from the apex position throughout the remaining portions of the pattern. Other curvatures are believed to be similarly useful. The preferred die pattern employs curves with softly rounded leading edges. A soft curve is preferred over a sharp curve in order to redistribute metal gradually and without tearing the metal.

FIG. 20 illustrates an alternate die pattern in which each leading edge curve 136 is a semi-circle. Adjacent semi-circular leading edge curves are joined by a trailing edge curve 138, which may be a semi-circle or other pattern. The semi-circular pattern offers a soft curve with a constantly changing tangent to its leading edge. As above, in a semi-circular pattern the tangent plane to the apex of a semi-circle is perpendicular to the central axis of the die. During the remainder of the curve, the tangent plane is disposed at an acute angle to the central axis, reaching 90° to the apex position, or parallel to the central axis, only at the point where the forward and rearwardly disposed curves are joined.

FIG. 21 illustrates an alternative pattern in which a leading edge curve 140 and a trailing edge curve 142 are joined by intermediate straight segments 144. The straight segments can provide a constant edge angle for uniform lateral displacement of metal, while the leading curve initiates the lateral redistribution. Thus, along the straight segments 144, the tangent plane can be viewed as being a constant with respect to the centerline or central axis of the die.

Although it is preferred that the lateral redistribution of material be accomplished during conventional can forming steps, this is not required. At any point, the workpiece can be processed in separate steps, by separate apparatus, to accomplish the redistribution.

Through redistribution of the extra metal or other material from the point areas of the hexagonal blank, material that conventionally would be scrap from the skeleton of the sheet stock is converted into intermediate portions of the container body 26. The reduced amount of scrap represents a substantial savings in metal or other material that otherwise must be reprocessed.

The apparatus and method as described above can be applied to forming lids and workpieces having shapes other than cylindrical. For example, by adjusting the cross-sectional shapes of the various appropriate dies, hexagonal cups 16 or container bodies 24 could be produced.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

I claim:

1. A tool for forming a blank into a container body having an open end, comprising:

a die having an annular shaping surface about a central axis; wherein:

said shaping surface is of substantially uniform radius with respect to said central axis; and at a plurality of preselected, spaced locations about the annular shaping surface, an edge of the shaping surface is disposed at an acute angle with respect to the central axis.

2. The tool of claim 1, wherein:

said shaping surface comprises a continuous face having a leading edge along one axially facing side thereof; and said leading edge comprises said edge that is disposed at an acute angle with respect to the central axis.

3. The tool of claim 2, wherein said continuous face is disposed in an undulated pattern.

4. The tool of claim 2, wherein said continuous face is disposed in a sinusoidal pattern.

5. The tool of claim 2, wherein said continuous face is disposed in a pattern of a series of semi-circular undulations.

6. The tool of claim 2, wherein said continuous face is disposed in a pattern of alternating curved and noncurved segments.

7. The tool of claim 2, wherein said continuous face is disposed in a pattern of equally spaced undulations.

8. The tool of claim 7, wherein said equally spaced undulations comprise six undulations extending axially forward.

9. The tool of claim 8, wherein said forwardly extending undulations comprise smooth curves.

10. The method of forming a container body with combined ironing of the container sidewall and lateral redistribution of sidewall material, comprising:

providing a blank of sheet material;

providing a punch moveable with the blank through a shaping die along a longitudinal axis;

providing a shaping die having an annular working surface positioned concentrically about said longitudinal axis of punch movement, wherein the annular working surface of the shaping die carries a face disposed in an undulated pattern and at a constant radius from the axis; and forming the container body with combined ironing of the container sidewall and lateral redistribution of sidewall material by moving the punch with the blank through the shaping die.

11. The method claim 10, wherein:

said blank is of noncircular geometric shape having a plurality of localized blank areas at preselected positions about its circumference from which blank material is to be laterally redistributed;

said undulated pattern of the shaping die comprises a plurality of axially forwardly extending undulations of circumferential spacing corresponding to the preselected positions of said localized blank areas;

and prior to said step of moving the punch through the shaping die, further comprising:

positioning said blank and shaping die with a localized blank area in axial alignment with a preselected undulation feature of the shaping die, whereby the preselected undulation feature laterally redistributes sidewall material from the localized blank area during the step of forming the container body.

12. The method of claim 11, wherein the shape of said blank comprises a hexagon, and said undulated pattern shaping die provides six forwardly extending undulations.

13. The method claim 10, wherein:

said blank is circular, having a plurality of localized blank areas at preselected positions about its circumference from which blank material is to be laterally redistributed;

said undulated pattern of the shaping die comprises a plurality of axially forwardly extending undulations of circumferential spacing corresponding to the preselected positions of said localized blank areas;

and prior to said step of moving the punch through the shaping die, further comprising:

positioning said blank and shaping die with a localized blank area in axial alignment with a preselected undulation feature of the shaping die, whereby the preselected undulation feature laterally redistributes sidewall material from the localized blank area during the step of forming the container body.

14. The method of claim 13, wherein the geometric shape of said blank is substantially a regular polygon having more than four side edges.

15. The method of claim 14, wherein said step of drawing the blank into a cup further comprises forming said blank into a cup having a side wall disposed substantially in the shape of said regular polygon.

16. The method of claim 15, wherein said step of re-drawing and ironing the cup into a container body having an open end further comprises forming said cup into a container body having a side wall disposed substantially in the shape of said regular polygon.

17. The method of claim 15, wherein said step of re-drawing and ironing the cup into a container body having an open end further comprises forming said cup into a container body having a side wall disposed substantially in the shape of a circle.

18. The method of claim 14, wherein said step of drawing the blank into a cup further comprises forming said blank into a cup having a side wall disposed substantially in the shape of a circle.

19. The method of claim 13, wherein the geometric shape of said blank is substantially a hexagon.

20. An improved apparatus for forming a cylindrical container from a generally hexagonal blank whose circumference is defined by six points separated by flats, for use in combination with a cupper that forms a hexagonal blank from sheet stock and draws the blank into a cylindrical cup, and further processes the blank in a body maker that redraws and irons the cup into a container body having an open end; wherein the improved apparatus comprises:

an annular die means having an annular shaping surface for longitudinally processing a blank passing through the center of the die means, having an element for laterally redistributing blank material oriented longitudinally within the annular shaping surface and at a leading edge of the die element with respect to the processing direction of the blank, wherein in use each of the elements for laterally redistributing blank material is aligned with a respective one of the points and laterally redistributes material from the area of the point toward the areas of the juxtaposed flats.

21. An improved process of forming a container, of the type employing the steps of forming from sheet stock a blank; drawing the blank into a cup; and further processing the blank by re-drawing and ironing the cup into a container body having an open end; wherein the improvement comprises:

providing a blank;

providing a means for laterally redistributing material from circumferentially spaced locations on the blank, said means including a die element defined by an annular shaping surface for longitudinally processing said blank and having spaced elements for laterally redistributing blank material positioned within the annular shaping surface at circumferentially spaced locations; and longitudinally processing the blank through said die element within the annular shaping surface, with said elements for laterally redistributing blank material applied to circumferentially spaced locations on the blank.

22. The method of claim 21, wherein the geometric shape of said blank is substantially a circle.

23. The method of claim 22, wherein said step of drawing the cup blank into a cup further comprises forming said blank into a cup having a side wall disposed substantially in the shape of a circle.

24. The method of claim 22, wherein said step of re-drawing and ironing the cup into a container body having an open end further comprises forming said cup into a container body having a side wall disposed substantially in the shape of a circle.

25. An apparatus for forming a cylindrical container from a generally circular blank, for use in combination with a cupper that forms a circular blank from sheet stock and draws the blank into a cylindrical cup, and further processes the blank in a body maker that redraws and irons the cup into a container body having an open end; wherein the improved apparatus comprises:

an annular die means having an annular shaping surface for longitudinally processing a blank passing through the center of the die means, having an element for laterally redistributing blank material oriented longitudinally within the annular shaping surface and at a leading edge of the die element with respect to the processing direction of the blank, wherein in use each of the elements for laterally redistributing blank material is in contact with the blank and laterally redistributes material from the area of contact toward a circumferentially juxtaposed area.

* * * * *